US011162371B2

(12) United States Patent
Lee et al.

(10) Patent No.: US 11,162,371 B2
(45) Date of Patent: Nov. 2, 2021

(54) TURBINE VANE, TURBINE BLADE, AND GAS TURBINE INCLUDING THE SAME

(71) Applicant: DOOSAN HEAVY INDUSTRIES & CONSTRUCTION CO., LTD., Changwon-si (KR)

(72) Inventors: Chang Yong Lee, Sejong-si (KR); Ji Yeon Lee, Seoul (KR)

( * ) Notice: Subject to any disclaimer, the term of this patent is extended or adjusted under 35 U.S.C. 154(b) by 161 days.

(21) Appl. No.: 16/543,337

(22) Filed: Aug. 16, 2019

(65) Prior Publication Data

US 2020/0116031 A1 Apr. 16, 2020

(30) Foreign Application Priority Data

Oct. 16, 2018 (KR) ..... 10-2018-0122953

(51) Int. Cl.
*F01D 5/18* (2006.01)
*F01D 17/16* (2006.01)

(52) U.S. Cl.
CPC ..... *F01D 5/189* (2013.01); *F01D 17/16* (2013.01)

(58) Field of Classification Search
CPC ..... F01D 5/187; F01D 5/188; F01D 5/189; F01D 9/065; F05D 2260/20; F05D 2260/201; F05D 2260/221; F05D 2260/2212; F05D 2260/2214; F05D 2260/22141
See application file for complete search history.

(56) References Cited

U.S. PATENT DOCUMENTS 4,820,123 A * 4/1989 Hall ..... F01D 25/32 416/97 R
5,279,111 A * 1/1994 Bell ..... F01D 5/085 415/115
6,416,275 B1 * 7/2002 Itzel ..... F01D 5/189 415/116
6,491,496 B2 12/2002 Starkweather
7,097,419 B2 * 8/2006 Lee ..... F01D 5/20 415/115
8,182,221 B1 * 5/2012 Liang ..... F01D 5/20 416/1

(Continued)

FOREIGN PATENT DOCUMENTS

JP 1990-023202 A 1/1990
KR 10-1770068 B1 8/2017

OTHER PUBLICATIONS

Machine translation of KR101770068 (Year: 2016).*

*Primary Examiner* — Woody A Lee, Jr.
*Assistant Examiner* — Brian O Peters
(74) *Attorney, Agent, or Firm* — Harvest IP Law, LLP

(57) ABSTRACT

A turbine vane and a turbine blade are provided. Each of the turbine vane and the turbine blade may include a sidewall configured to form an airfoil and include a leading edge and a trailing edge, a partition wall configured to partition an internal space of the sidewall to form a plurality of cooling channels, and a metering plate configured to block inlet parts of the cooling channels and include cooling holes communicating with respective cooling channels. The metering plate may include a first cooling hole formed in the inlet part of each of the cooling channels and a second cooling hole formed, at a position close to the leading edge, in the inlet part of the cooling channel adjacent to the leading edge among the plurality of cooling channels.

18 Claims, 9 Drawing Sheets

(56) References Cited

U.S. PATENT DOCUMENTS

| | | | | |
|---|---|---|---|---|
| 8,591,189 | B2 * | 11/2013 | Correia | F01D 5/187 416/96 R |
| 9,234,432 | B2 * | 1/2016 | Shinoda | F01D 9/02 |
| 2007/0212228 | A1 | 9/2007 | Digard Brou De Cuissart et al. | |
| 2014/0314568 | A1 * | 10/2014 | Vetters | F01D 11/24 416/1 |
| 2017/0009590 | A1 | 1/2017 | Nilsson | |

* cited by examiner

TURBINE VANE, TURBINE BLADE, AND GAS TURBINE INCLUDING THE SAME

CROSS-REFERENCE TO RELATED APPLICATION

This application claims priority to Korean Patent Application No. 10-2018-0122953, filed on Oct. 16, 2018, the disclosure of which is incorporated herein by reference in its entirety.

BACKGROUND

Field

Apparatuses and methods consistent with exemplary embodiments relate to a turbine vane, a turbine blade, and a gas turbine including the same.

Description of the Related Art

Turbines are machines that obtain rotational force by impulsive force or reaction force using a flow of compressive fluid such as steam or gas, and include a steam turbine using steam, a gas turbine using high-temperature combustion gas, and so forth.

The gas turbine includes a compressor, a combustor, and a turbine. The compressor includes an air inlet into which air is introduced, and a plurality of compressor vanes and a plurality of compressor blades which are alternately provided in a compressor housing.

The combustor is configured to supply fuel into air compressed by the compressor and ignite the fuel mixture using a burner to generate high-temperature and high-pressure combustion gas.

The turbine includes a plurality of turbine vanes and a plurality of turbine blades which are alternately arranged in a turbine housing. Furthermore, a rotor is disposed passing through central portions of the compressor, the combustor, the turbine, and an exhaust chamber.

The rotor is rotatably supported at both ends thereof by bearings. A plurality of disks are fixed to the rotor, and the plurality of blades are coupled to corresponding disks, respectively. A driving shaft of a generator is coupled to an end of the rotor that is adjacent to the exhaust chamber.

A gas turbine does not have a reciprocating component such as a piston which is usually provided in a four-stroke engine. That is, the gas turbine has no mutual friction parts such as a piston-and-cylinder, thereby having advantages in that there is little consumption of lubricant, and an amplitude of vibration is markedly reduced unlike a reciprocating machine having high-amplitude characteristics Therefore, high-speed driving of the gas turbine is possible.

A brief description of the operation of the gas turbine is as follows. Air compressed by the compressor is mixed with fuel, the fuel mixture is combusted to generate high-temperature combustion gas, and the generated combustion gas is discharged to the turbine. The discharged combustion gas passes through the turbine vanes and the turbine blades and generates rotating force by which the rotor is rotated.

SUMMARY

Aspects of one or more exemplary embodiments provide a turbine vane, a turbine blade, and a gas turbine including the same, in which cooling fluid may be satisfactorily drawn into a front part of a lower end of a leading edge, whereby the cooling performance may be enhanced.

Additional aspects will be set forth in part in the description which follows and, in part, will become apparent from the description, or may be learned by practice of the exemplary embodiments.

According to an aspect of an exemplary embodiment, there is provided a turbine vane including: a sidewall configured to form an airfoil and include a leading edge and a trailing edge; a partition wall configured to partition an internal space of the sidewall to form a plurality of cooling channels; and a metering plate configured to block inlet parts of the plurality of cooling channels and having cooling holes communicating with respective cooling channels, wherein the metering plate includes a first cooling hole formed in the inlet part of each of the plurality of cooling channels and a second cooling hole formed, at a position close to the leading edge, in the inlet part of the cooling channel adjacent to the leading edge among the plurality of cooling channels.

Cooling air drawn through the second cooling hole may cool a leading edge region of the sidewall.

The first cooling hole may have a rectangular shape, and the second cooling hole may have a circular shape.

The first cooling hole may have a circular or an elliptical shape, and the second cooling hole may have a circular or an elliptical shape.

The first cooling hole may have a rectangular shape, and the second cooling hole may have a rectangular shape.

The metering plate may further include a conductor provided on an upper surface of a leading edge side of a portion defining the second cooling hole and configured to cool a leading edge region through a conduction using a cooling air.

The second cooling hole may be formed to be inclined toward the leading edge.

The metering plate may further include a guide provided on an upper surface of a trailing edge side of a portion defining the second cooling hole and configured to guide cooling fluid to a leading edge region.

According to an aspect of another exemplary embodiment, there is provided a turbine blade including: a sidewall configured to form an airfoil and include a leading edge and a trailing edge; a partition wall configured to partition an internal space of the sidewall to form a plurality of cooling channels; and a metering plate configured to block inlet parts of the plurality of cooling channels and include cooling holes communicating with respective cooling channels, wherein the metering plate includes a first cooling hole formed in the inlet part of each of the plurality of cooling channels and a second cooling hole formed, at a position close to the leading edge, in the inlet part of the cooling channel adjacent to the leading edge among the plurality of cooling channels.

Cooling air drawn through the second cooling hole cools a leading edge region of the sidewall.

The first cooling hole may have a rectangular shape, and the second cooling hole may have a circular shape.

The first cooling hole may have a circular or an elliptical shape, and the second cooling hole has a circular or an elliptical shape.

The first cooling hole may have a rectangular shape, and the second cooling hole has a rectangular shape.

The metering plate may further include a conductor provided on an upper surface of a leading edge side of a portion defining the second cooling hole and configured to cool a leading edge region through a conduction using a cooling air.

The second cooling hole may be formed to be inclined toward the leading edge.

The metering plate further comprises a guide provided on an upper surface of a trailing edge side of a portion defining the second cooling hole and configured to guide cooling fluid to a leading edge region.

According to an aspect of another exemplary embodiment, there is provided a gas turbine including: a compressor configured to suction external air thereinto and compress the air; a combustor configured to mix fuel with air compressed by the compressor and combust a mixture of the fuel and the air; and a turbine configured to include a turbine blade and a turbine vane that are mounted in the turbine so that the turbine blade is rotated by combustion gas discharged from the combustor, wherein the turbine vane includes: a sidewall configured to form an airfoil and include a leading edge and a trailing edge; a partition wall configured to partition an internal space of the sidewall to form a plurality of cooling channels; and a metering plate configured to block inlet parts of the plurality of cooling channels and include cooling holes communicating with respective cooling channels, and wherein the metering plate includes a first cooling hole formed in the inlet part of each of the plurality of cooling channels and a second cooling hole formed, at a position close to the leading edge, in the inlet part of the cooling channel adjacent to the leading edge among the plurality of cooling channels.

Cooling air drawn through the second cooling hole may cool a leading edge region of the sidewall.

The metering plate may further include a conductor provided on an upper surface of a leading edge side of a portion defining the second cooling hole and configured to cool a leading edge region through a conduction using a cooling air.

The metering plate may further include a guide provided on an upper surface of a trailing edge side of a portion defining the second cooling hole and configured to guide cooling fluid to a leading edge region.

In accordance with one or more exemplary embodiments, cooling fluid may be satisfactorily drawn into a front part of a lower end of a leading edge, whereby the cooling performance may be enhanced.

It is to be understood that both the foregoing general description and the following detailed description of exemplary embodiments are exemplary and explanatory and are intended to provide further explanation of the disclosure as claimed.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
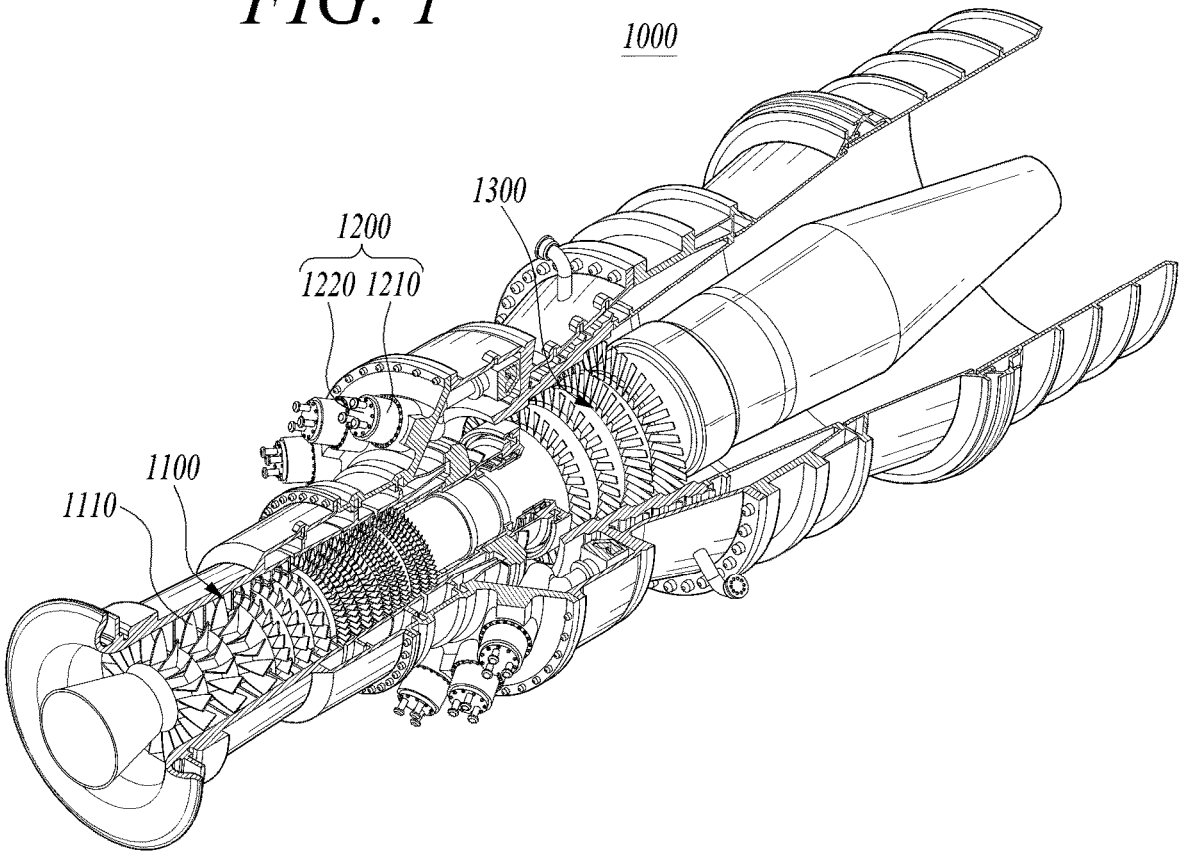
FIG. 1 is a partially exploded perspective view of a gas turbine in accordance with an exemplary embodiment.

Various modifications and various embodiments will be described in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

The terminology used herein is for the purpose of describing specific embodiments only and is not intended to limit the scope of the disclosure. The singular expressions "a", "an", and "the" are intended to include the plural expressions as well, unless the context clearly indicates otherwise. In the disclosure, the terms such as "comprise", "include", "have/has" should be construed as designating that there are such features, integers, steps, operations, elements, components, and/or combinations thereof, not to exclude the presence or possibility of adding of one or more of other features, integers, steps, operations, elements, components, and/or combinations thereof.

Hereinafter, exemplary embodiments will be described in detail with reference to the accompanying drawings. Reference now should be made to the drawings, in which the same reference numerals are used throughout the different drawings to designate the same or similar components. Details of well-known configurations and functions may be omitted to avoid unnecessarily obscuring the gist of the present disclosure. For the same reason, in the accompanying drawings, some elements are enlarged, omitted, or depicted schematically.

Figure 2:
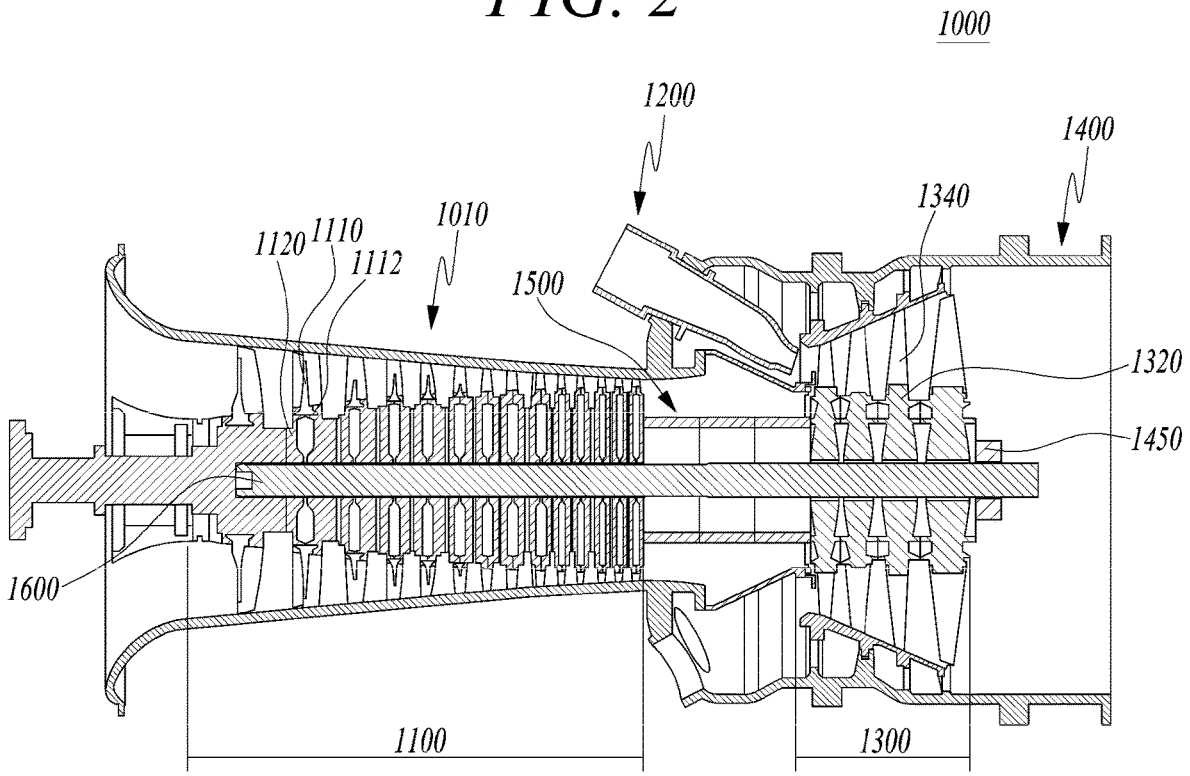
FIG. 2 is a sectional view illustrating a schematic structure of the gas turbine in accordance with an exemplary embodiment.
Figure 3:
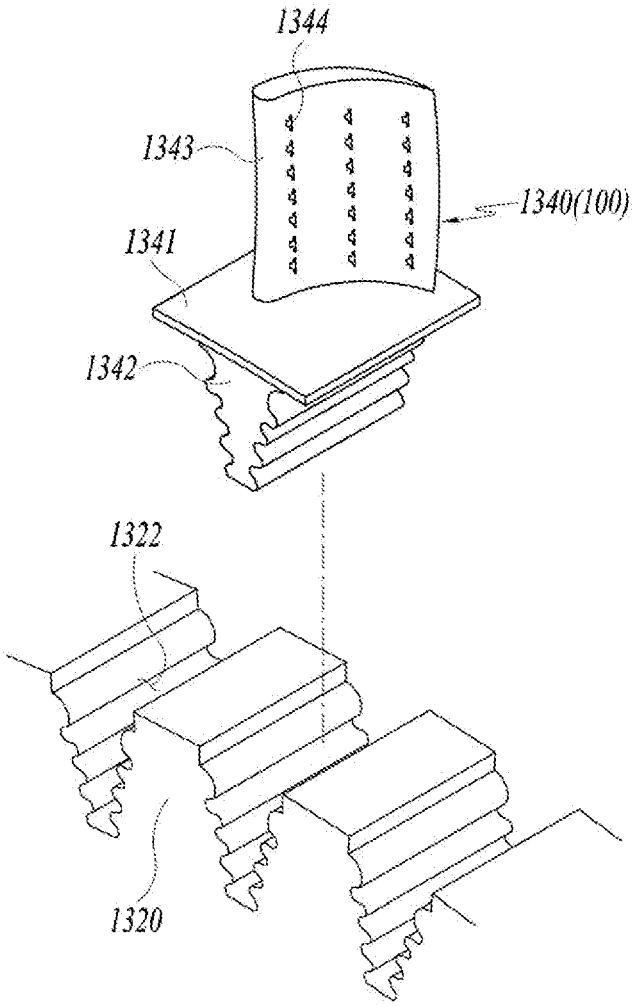
FIG. 3 is an exploded perspective view illustrating a turbine rotor disk of FIG. 2.

FIG. 1 is a partially exploded perspective view of a gas turbine in accordance with an exemplary embodiment. FIG. 2 is a sectional view illustrating a schematic structure of the gas turbine in accordance with an exemplary embodiment. FIG. 3 is an exploded perspective view illustrating a turbine rotor disk of FIG. 2.

Referring to FIG. 1, the gas turbine 1000 may include a compressor 1100, a combustor 1200, and a turbine 1300. The compressor 1100 including a plurality of blades 1110 radially installed rotates the blades 1110, and air is compressed and moved by the rotation of the blades 1110. A size and installation angle of each of the blades 1110 may be changed depending on an installation position thereof. The compressor 1100 is directly or indirectly coupled with the turbine 1300, and may receive some of power generated from the turbine 1300 and use the received power to rotate the blades 1110.

Air compressed by the compressor 1100 may be moved to the combustor 1200. The combustor 1200 may include a plurality of combustion chambers 1210 and a plurality of fuel nozzle modules 1220 which are arranged in an annular shape.

Referring to FIG. 2, the gas turbine 1000 may include a housing 1010 and a diffuser 1400 provided behind the housing 1010 to discharge the combustion gas passing through the turbine 1300. The combustor 1200 is disposed in front of the diffuser 1400 to combust the compressed air supplied thereto.

Based on a flow direction of air, the compressor 1100 is disposed at an upstream side, and the turbine 1300 is disposed at a downstream side. In addition, a torque tube 1500 serving as a torque transmission member for transmitting rotational torque generated from the turbine 1300 to the compressor 1100 is disposed between the compressor 1100 and the turbine 1300.

The compressor 1100 includes a plurality of compressor rotor disks 1120, each of which is fastened by a tie rod 1600 to prevent axial separation in an axial direction of the tie rod 1600.

For example, the compressor rotor disks 1120 are aligned with each other along an axial direction in such a way that the tie rod 1600 that forms a rotating shaft passes through central portions of the compressor rotor disks 1120. Here, adjacent compressor rotor disks 1120 are arranged so that facing surfaces thereof are in tight contact with each other by being pressed by the tie rod 1600. The adjacent compressor rotor disks 1120 cannot rotate relative to each other because of this arrangement.

A plurality of blades 1110 are radially coupled to an outer circumferential surface of each of the compressor rotor disks 1120. Each of the blades 1110 includes a dovetail part 1112 by which the blade 1110 is coupled to the compressor rotor disk 1120.

A plurality of compressor vanes are fixedly arranged between each of the compressor rotor disks 1120 in the housing 1010. While the compressor rotor disks 1120 rotate along with a rotation of the tie rod 1600, the compressor vanes fixed to the housing 1010 do not rotate. The compressor vanes guide the flow of compressed air moved from front-stage compressor blades 1110 to rear-stage compressor blades 1110.

A coupling scheme of the dovetail part 1112 is classified into a tangential type and an axial type. This may be selected depending on a structure of the gas turbine to be used, and may have a dovetail shape or fir-tree shape. In some cases, the compressor blade 1110 may be coupled to the compressor rotor disk 1120 by using other types of coupling device, such as a key or a bolt.

The tie rod 1600 is disposed passing through central portions of the plurality of compressor rotor disks 1120 and a plurality of turbine rotor disks 1320. The tie rod 1600 may be a single or multi-tie rod structure. One end of the tie rod 1600 is coupled to the compressor rotor disk 1120 that is disposed at the most upstream side, and the other end thereof is coupled with a fastening nut 1450.

It is understood that the shape of the tie rod 1600 is not limited to the example illustrated in FIG. 2, and may be changed or vary according to one or more other exemplary embodiments. For example, a single tie rod may be disposed passing through the central portions of the rotor disks, a plurality of tie rods may be arranged in a circumferential direction, or a combination thereof is also possible.

Also, a vane functioning as a guide vane may be installed at the rear stage of the diffuser of the compressor 1100 so as to adjust an actual flow angle of fluid entering into an inlet of the combustor and increase the pressure of the fluid. This vane is referred to as a deswirler.

The combustor 1200 mixes introduced compressed air with fuel, combusts the fuel mixture to generate high-temperature and high-pressure combustion gas having high energy, and increases, through an isobaric combustion process, the temperature of the combustion gas to a temperature at which the combustor and the turbine can endure.

A plurality of combustors constituting the combustor 1200 may be arranged in a housing in a form of a cell. Each of the combustors includes a burner including a fuel injection nozzle, etc., a combustor liner forming a combustion chamber, and a transition piece serving as a connector between the combustor and the turbine.

The combustor liner provides a combustion space in which fuel discharged from the fuel injection nozzle is mixed with compressed air supplied from the compressor and combusted. The combustor liner may include a flame tube for providing the combustion space in which the fuel mixed with air is combusted and a flow sleeve for forming an annular space enclosing the flame tube. The fuel injection nozzle is coupled to a front end of the combustor liner, and an ignition plug is coupled to a sidewall of the combustor liner.

The transition piece is connected to a rear end of the combustor liner to transfer combustion gas combusted by the ignition plug toward the turbine. An outer wall of the transition piece is cooled by compressed air supplied from the compressor to prevent the transition piece from being damaged by high-temperature combustion gas.

To this end, the transition piece has cooling holes through which the compressed air can be injected. Compressed air cools the inside of the transition piece through the cooling holes and then flows toward the combustor liner.

The compressed air that has cooled the transition piece may flow into an annular space of the combustor liner and may be provided as a cooling air from the outside of the flow sleeve through the cooling holes formed in the flow sleeve to an outer wall of the combustor liner.

The high-temperature and high-pressure combustion gas ejected from the combustor 1200 is supplied to the turbine 1300. The supplied high-temperature and high-pressure combustion gas expands and applies impingement or reaction force to the turbine blades to generate rotational torque. A portion of the rotational torque is transmitted to the compressor 1100 via the torque tube, and the remaining portion which is the excessive torque is used to drive the generator or the like.

The turbine 1300 basically has a structure similar to that of the compressor 1100. That is, the turbine 1300 may include a plurality of turbine rotor disks 1320 similar to the compressor rotor disks 1120 of the compressor 1100. Each turbine rotor disk 1320 includes a plurality of turbine blades 1340 which are radially disposed. Each turbine blade 1340 may be coupled to the turbine rotor disk 1320 in a dovetail coupling manner. In addition, turbine vanes fixed to the housing 1010 are provided between the turbine blades 1340 of the turbine rotor disk 1320 to guide a flow direction of combustion gas passing through the turbine blades 1340.

Referring to FIG. 3, the turbine rotor disk 1320 has an approximately circular plate shape, and includes a plurality of coupling slots 1322 formed in an outer circumferential surface thereof. Each of the coupling slots 1322 has a fir-tree-shaped corrugated surface.

The turbine blade 1340 is coupled to the coupling slot 1322 and includes, in an approximately central portion thereof, a platform part 1341 having a planar shape. The platform part 1341 has a side surface which comes into contact with a side surface of the platform part 1341 of a neighboring turbine blade to maintain an interval between the adjacent blades.

A root part 1342 is provided under a lower surface of the platform part 1341. The root part 1342 has an axial-type structure so that the root part 1342 is inserted into the coupling slot 1322 of the rotor disk 1320 along an axial direction of the rotor disk 1320.

The root part 1342 has an approximately fir-tree-shaped corrugated portion corresponding to the fir-tree-shaped corrugated surface formed in the coupling slot 1322. It is understood that the coupling structure of the root part 1342 is not limited to a fir-tree shape, and may be formed to have a dovetail structure.

A blade part 1343 is formed on an upper surface of the platform part 1341 to have an optimized airfoil shape according to specifications of the gas turbine. The blade part 1343 includes a leading edge which is disposed at an upstream side with respect to the flow direction of the combustion gas, and a trailing edge which is disposed at a downstream side.

The turbine blade 1340 comes into contact with high-temperature and high-pressure combustion gas. Because the combustion gas has a high temperature reaching 1700° C., a cooling unit is required. To this end, the gas turbine includes a cooling passage through which some of the compressed air is drawn out from some portions of the compressor and is supplied to the turbine blades.

The cooling passage may extend outside the housing (i.e., an external passage), or extend through the interior of the rotor disk (i.e., an internal passage), or both of the external passage and the internal passage may be used. A plurality of film cooling holes 1344 are formed in a surface of the blade part 1343. The film cooling holes 1344 communicate with a cooling passage formed in the blade part 1343 to supply cooling air to the surface of the blade part 1343.

The blade part 1343 is rotated by combustion gas in the housing. A gap is formed between an end of the blade part 1343 and the inner surface of the housing so that the blade part 1343 can smoothly rotate. However, because the combustion gas may leak through the gap, a sealing unit is needed to prevent the leakage of combustion gas.

Each of the turbine vanes and the turbine blades having an airfoil shape includes a leading edge, a trailing edge, a suction side, and a pressure side. An internal structure of the turbine vane and the turbine blade has a complex maze structure forming a cooling system. A cooling circuit in the turbine vane and the turbine blade receives cooling fluid, e.g., air, from the compressor, and the fluid passes through the ends of the vane and the blade. The cooling circuit includes a plurality of flow passages to maintain temperatures of all surfaces of the turbine vane and the turbine blade constant. At least some of fluid passing the cooling circuit is discharged through the leading edge, the trailing edge, the suction side, and the pressure side of the turbine vane.

A plurality of cooling channels forming the cooling circuit are provided in the turbine vane and the turbine blade. A metering plate is provided at an inlet of the plurality of cooling channels. Cooling holes corresponding to respective inlets of the cooling channels are formed in the metering plate.

Here, cooling fluid forms strong jets while passing through the cooling holes of the metering plate. Because a flow stagnation region occurs in a front part of a lower end of the leading edge, there is a problem in that the performance of cooling the front part of the lower end of the leading edge is reduced.

Figure 4A:
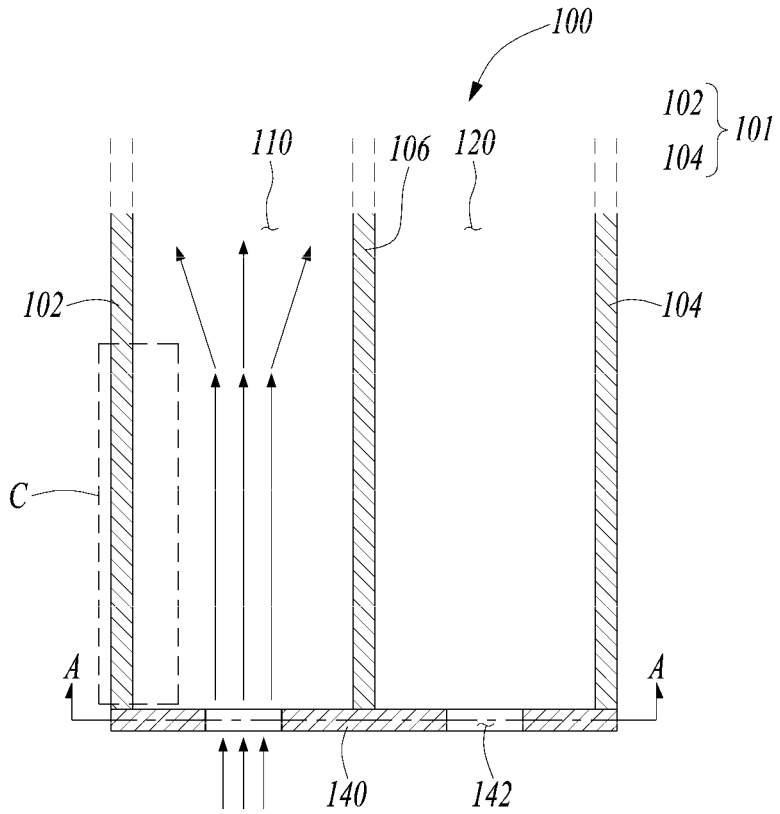
FIG. 4A (Related Art)
FIGS. 4A and 4B are sectional views illustrating a related art turbine vane or a turbine blade.
Figure 4B:
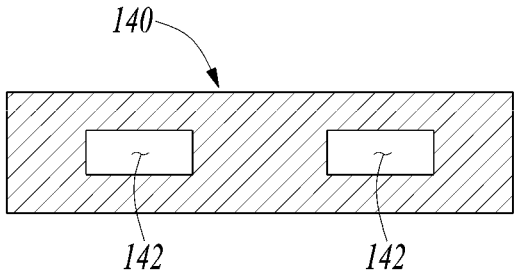
FIG. 4B (Related Art)
Figure 5A:
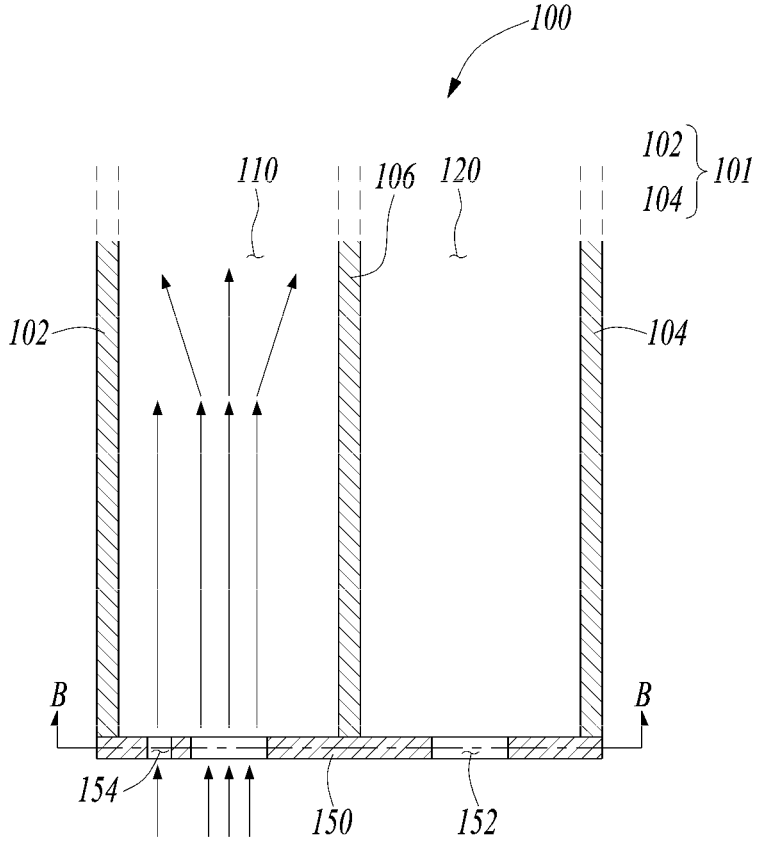
FIGS. 5A and 5B are sectional views illustrating a turbine vane or a turbine blade in accordance with an exemplary embodiment.
Figure 5B:
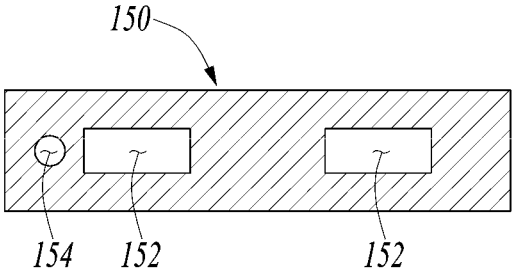

FIGS. 4A and 4B are sectional views illustrating a related art turbine vane or a turbine blade. FIGS. 5A and 5B are sectional views illustrating a turbine vane or a turbine blade in accordance with an exemplary embodiment.

FIG. 4A is a longitudinal sectional view illustrating a lower part of the turbine vane or the turbine blade. FIG. 4B is a sectional view taken along line A-A of FIG. 4A passing through a metering plate 140.

Referring to FIGS. 4A and 4B, a turbine vane or turbine blade 100 includes a sidewall 101, a partition wall 106, and a metering plate 140. The sidewall 101 forms an airfoil including a leading edge 102 and a trailing edge 104. The partition wall 106 partitions an internal space of the sidewall 101 to form a plurality of cooling channels 110 and 120. The metering plate 140 blocks inlet parts of the plurality of cooling channels 110 and 120 and communicates with each of the cooling channels 110 and 120.

For example, a concave surface of the airfoil formed by the sidewall refers to a pressure surface, and a convex surface refers to a suction surface.

Although FIGS. 4 and 5 illustrate an example in which the cooling channel formed in the internal space of the sidewall 101 is partitioned by the single partition wall 106 into two channels including a first channel 110 and a second channel 120, the cooling channels may be formed in various shapes, and the number of cooling channels may be changed to various values, e.g., three to ten.

The metering plate 140 is coupled to the inlet parts of the plurality of cooling channels 110 and 120, and cooling holes 142 corresponding to the respective cooling channels are formed in the metering plate 140.

The flow of cooling fluid in the first channel 110 adjacent to the leading edge 102 is shown by arrows in FIG. 4A. In the related art, cooling fluid is not properly supplied to a front part of a lower end of the leading edge 102, i.e., a portion "C". Thus, there may be a problem in that the portion "C" is not sufficiently cooled.

On the other hand, the metering plate 150 in accordance with an exemplary embodiment illustrated in FIGS. 5A and 5B includes a first cooling hole 152 formed in the inlet part of each of the plurality of cooling channels 110 and 120, and a second cooling hole 154 formed in the inlet part of the cooling channel 110 adjacent to the leading edge 102 among the plurality of cooling channels at a position close to the leading edge 102.

FIG. 5A is a longitudinal sectional view illustrating a lower part of the turbine vane or the turbine blade. FIG. 5B is a sectional view taken along line B-B of FIG. 5A passing through a metering plate 150.

Although FIG. 5A illustrates an example which includes the first channel 110 and the second channel 120, the number of cooling channels may be changed.

Referring to FIG. 5A, the inlet part of the second channel 120 includes the single cooling hole 152, and the inlet part of the first channel 110 includes the first cooling hole 152 formed in the inlet part and the second cooling hole 154 formed at a position adjacent to the leading edge 102 of the cooling channel 110.

The first cooling hole 152 of the first channel 110 has the same size as that of the cooling hole 152 of the second channel 120 and may be formed in a central portion of the inlet part of corresponding channel. Furthermore, the first cooling hole 152 of the first channel 110 may be formed at a position moved slightly to the right compared to the cooling hole 152 of the second channel 120, i.e., toward the trailing edge 104. The first cooling hole 152 may be slightly smaller than the second cooling hole 152.

Because the second cooling hole 154 is formed in the metering plate 150 at a position close to an inner side surface of the leading edge 102, cooling air drawn through the second cooling hole 154 may cool a lower portion of the leading edge 102 of the sidewall 101.

Referring to FIG. 5B, the first cooling hole 152 may have a rectangular shape, and the second cooling hole 154 may have a circular shape.

Each of the first channel 110 and the second channel 120 has an overall elongated rectangular horizontal cross-section. Given this, the first cooling hole 152 formed in the inlet part of the each channel may have a rectangular shape.

Considering that the inner side surface of the leading edge 102 has a concave curved surface, the second cooling hole 154 may have a circular shape.

Figure 6A:
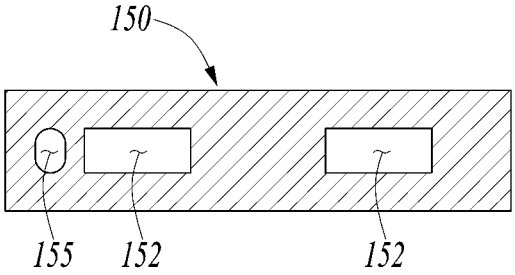
FIGS. 6A, 6B, and 6C are sectional views illustrating exemplary embodiments of a metering plate.
Figure 6B:
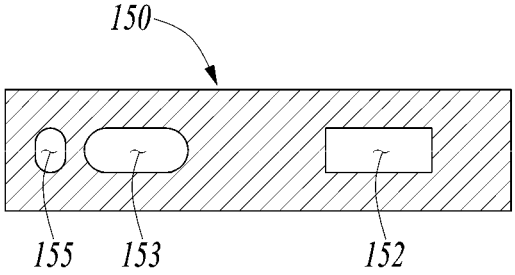
Figure 6C:
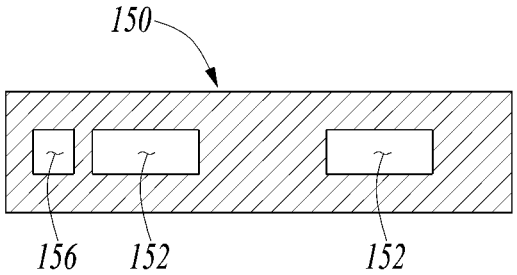

FIGS. 6A, 6B, and 6C illustrate one or more exemplary embodiments of the metering plate 150.

Referring to FIG. 6A, a first cooling hole 152 may have a rectangular shape, and a second cooling hole 155 may have an elliptical shape.

The major axis of the second cooling hole 155 may be disposed in a direction parallel to a short side of the first cooling hole 152.

Here, the term "ellipse" may include a shape in which a semicircle is integrally connected to each of the opposite short sides of the rectangle.

Referring to FIG. 6B, a first cooling hole 153 may have an elliptical shape, and a second cooling hole 155 may also have an elliptical shape.

For example, each of corners in the sidewall 101 and the partition wall 106 may be rounded with a predetermined curvature radius.

Furthermore, a circumferential cross-section of the turbine vane or the turbine blade 100 may have an airfoil shape which is gradually reduced in an area toward the end thereof opposite to the metering plate 150.

Because the second cooling hole 155 and the first cooling hole 153 may have an elliptical shape, the major axis of the second cooling hole 155 may be same as the major axis of the first cooling hole 153.

Referring to FIG. 6C, a first cooling hole 152 may have a rectangular shape, and a second cooling hole 156 may also have a rectangular shape.

A long side of the second cooling hole 156 may have the same length as a short side of the first cooling hole 152.

Figure 7:
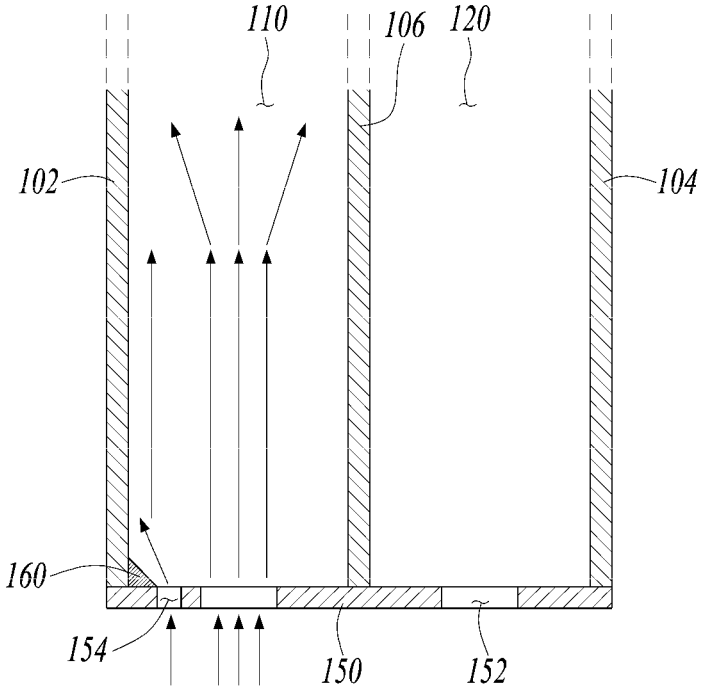
FIGS. 7 to 9 are diagrams illustrating exemplary embodiments of a turbine vane or a turbine blade.
Figure 8:
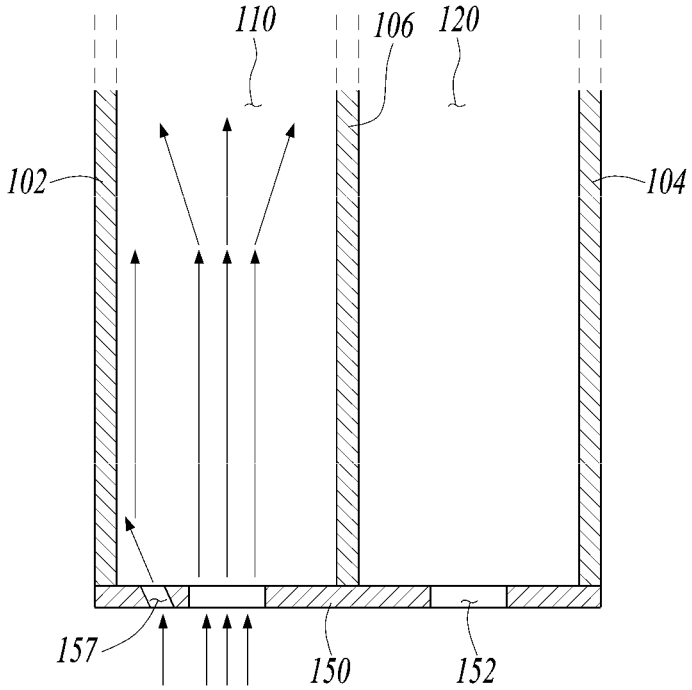
Figure 9:
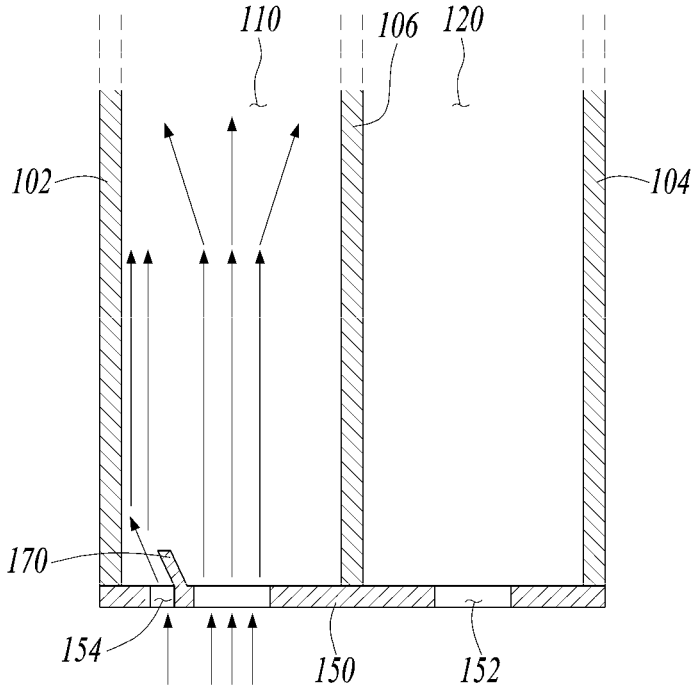

FIGS. 7 to 9 illustrate one or more exemplary embodiments of a turbine vane or a turbine blade.

Referring to FIG. 7, the metering plate 150 may further include a conductor 160 provided on an upper surface of a leading edge side of a portion defining the second cooling hole 154 so as to cool the leading edge region through conduction using cooling air.

The conductor 160 extends on the upper surface of the metering plate 150 from a leading-edge side of the second cooling hole 154 to a lower end of the inner surface of the leading edge 102.

The conductor 160 may have a right triangle-shaped cross-section, and may be integrally formed, using metal, with the metering plate 150. An upper surface of the conductor 160 may have a curved surface which is concave upward.

Due to the conductor 160, cooling fluid, i.e., cooling air, drawn through the second cooling hole 154 may be more smoothly transmitted to the leading edge 102.

Referring to FIG. 8, the second cooling hole 157 may be formed to be inclined toward the leading edge 102.

Because the metering plate 150 has a predetermined thickness, the second cooling hole 157 may be formed in the metering plate 150 at an angle inclined toward the leading edge 102. Cooling fluid drawn through the second cooling hole 157 may be transferred to the lower end of the inner side surface of the leading edge 102.

Therefore, compared to the second cooling hole 154 of FIG. 5 that is penetrated in a vertical direction, the second cooling hole 157 of FIG. 8 may concentrate cooling fluid on the lower end of the inner side surface of the leading edge 102, whereby the effect of cooling the lower end of the leading edge 102 may be further enhanced.

Referring to FIG. 9, the metering plate 150 may further include a guide 170 provided on an upper surface of a trailing edge side of a portion defining the second cooling hole 154 so as to guide cooling fluid to the leading edge 102.

The guide 170 may be disposed on the upper surface of the metering plate 150 and extend from a right side of the second cooling hole 154 to leftward and upward.

The guide 170 guides cooling fluid drawn through the second cooling hole 154 toward the lower end of the inner side surface of the leading edge 102, thus enhancing the effect of cooling the lower end of the leading edge 102.

The guide 170 of FIG. 9 may also be applied to the exemplary embodiment of FIG. 7 or FIG. 8. Furthermore, the conductor 160 of FIG. 7 and the inclined second cooling hole 157 of FIG. 8 may be used together. The shape of each of the metering plates 150 of FIGS. 7 to 9 may also be applied to the exemplary embodiments of FIGS. 5A to 6C.

In accordance with a turbine vane or a turbine blade of the exemplary embodiments, cooling fluid may be satisfactorily drawn into a front part of a lower end of a leading edge, whereby the cooling performance may be enhanced.

While one or more exemplary embodiments have been described with reference to the accompanying drawings, it is to be understood by those skilled in the art that various modifications and changes in form and details can be made therein without departing from the spirit and scope as defined by the appended claims. Therefore, the description of the exemplary embodiments should be construed in a descriptive sense only and not to limit the scope of the claims, and many alternatives, modifications, and variations will be apparent to those skilled in the art.

What is claimed is:

1. A turbine vane comprising:

a sidewall configured to form an airfoil and include a leading edge and a trailing edge;

a partition wall configured to partition an internal space of the sidewall to form a plurality of cooling channels; and a metering plate configured to block inlet parts of the plurality of cooling channels and include cooling holes communicating with respective cooling channels, wherein the metering plate includes a first cooling hole formed in the inlet part of each of the plurality of cooling channels and a second cooling hole formed directly behind the leading edge in the inlet part of the cooling channel adjacent to the leading edge among the plurality of cooling channels, the second cooling hole having a size smaller than a size of the first cooling hole, and wherein the second cooling hole is formed in the metering plate to be inclined toward the leading edge to transfer a cooling air to a lower end of an inner side surface of the leading edge.

2. The turbine vane according to claim 1, wherein the cooling air drawn through the second cooling hole cools a leading edge region of the sidewall.

3. The turbine vane according to claim 2, wherein the first cooling hole has a rectangular shape, and wherein the second cooling hole has a circular shape.

4. The turbine vane according to claim 2, wherein the first cooling hole has a circular or an elliptical shape, and wherein the second cooling hole has a circular or an elliptical shape.

5. The turbine vane according to claim 2, wherein the first cooling hole has a rectangular shape, and wherein the second cooling hole has a rectangular shape.

6. The turbine vane according to claim 1, wherein the metering plate further comprises a conductor provided on an upper surface of a leading edge side of a portion defining the second cooling hole and configured to cool a leading edge region through a conduction using a cooling air.

7. The turbine vane according to claim 1, wherein the metering plate further comprises a guide provided on an upper surface of a trailing edge side of a portion defining the second cooling hole and configured to guide cooling fluid to a leading edge region.

8. A turbine blade comprising:

a sidewall configured to form an airfoil and include a leading edge and a trailing edge;

a partition wall configured to partition an internal space of the sidewall to form a plurality of cooling channels; and a metering plate configured to block inlet parts of the plurality of cooling channels and include cooling holes communicating with respective cooling channels, wherein the metering plate includes a first cooling hole formed in the inlet part of each of the plurality of cooling channels and a second cooling hole formed directly behind the leading edge in the inlet part of the cooling channel adjacent to the leading edge among the plurality of cooling channels, the second cooling hole having a size smaller than a size of the first cooling hole, and wherein the second cooling hole is formed in the metering plate to be inclined toward the leading edge to transfer a cooling air to a lower end of an inner side surface of the leading edge.

9. The turbine blade according to claim 8, wherein the cooling air drawn through the second cooling hole cools a leading edge region of the sidewall.

10. The turbine blade according to claim 9, wherein the first cooling hole has a rectangular shape, and wherein the second cooling hole has a circular shape.

11. The turbine blade according to claim 9, wherein the first cooling hole has a circular or an elliptical shape, and wherein the second cooling hole has a circular or an elliptical shape.

12. The turbine blade according to claim 9, wherein the first cooling hole has a rectangular shape, and wherein the second cooling hole has a rectangular shape.

13. The turbine blade according to claim 8, wherein the metering plate further comprises a conductor provided on an upper surface of a leading edge side of a portion defining the second cooling hole and configured to cool a leading edge region through a conduction using a cooling air.

14. The turbine blade according to claim 8, wherein the metering plate further comprises a guide provided on an upper surface of a trailing edge side of a portion defining the second cooling hole and configured to guide cooling fluid to a leading edge region.

15. A gas turbine comprising:

a compressor configured to suction external air thereinto and compress the air;

a combustor configured to mix fuel with air compressed by the compressor and combust a mixture of the fuel and the air; and a turbine configured to include a turbine blade and a turbine vane that are mounted in the turbine so that the turbine blade is rotated by combustion gas discharged from the combustor, wherein the turbine vane comprises:

a sidewall configured to form an airfoil and include a leading edge and a trailing edge;

a partition wall configured to partition an internal space of the sidewall to form a plurality of cooling channels; and a metering plate configured to block inlet parts of the plurality of cooling channels and include cooling holes communicating with respective cooling channels, and wherein the metering plate includes a first cooling hole formed in the inlet part of each of the plurality of cooling channels and a second cooling hole formed directly behind the leading edge in the inlet part of the cooling channel adjacent to the leading edge among the plurality of cooling channels, the second cooling hole having a size smaller than a size of the first cooling hole, and wherein the second cooling hole is formed in the metering plate to be inclined toward the leading edge to transfer a cooling air to a lower end of an inner side surface of the leading edge.

16. The gas turbine according to claim 15, wherein the cooling air drawn through the second cooling hole cools a leading edge region of the sidewall.

17. The gas turbine according to claim 15, wherein the metering plate further comprises a conductor provided on an upper surface of a leading edge side of a portion defining the second cooling hole and configured to cool a leading edge region through a conduction using a cooling air.

18. The gas turbine according to claim 15, wherein the metering plate further comprises a guide provided on an upper surface of a trailing edge side of a portion defining the second cooling hole and configured to guide cooling fluid to a leading edge region.

* * * * *